United States Patent [19]
Montrouil
[11] 4,270,332
[45] Jun. 2, 1981

[54] WINDOWS AND METHOD OF MAKING THE SAME

[75] Inventor: George W. Montrouil, Palo Alto, Calif.

[73] Assignee: Montrouil Enterprises, Inc., Palo Alto, Calif.

[21] Appl. No.: 755,642

[22] Filed: Dec. 30, 1976

Related U.S. Application Data

[62] Division of Ser. No. 603,046, Aug. 8, 1975, Pat. No. 4,115,964.

[51] Int. Cl.³ ..... E04C 1/34

[52] U.S. Cl. ..... 52/772; 52/466; 52/467; 52/770; 52/780

[58] Field of Search ..... 52/772, 106, 466, 467, 52/468, 460, 461, 770, 771, 780, 781

[56] References Cited

U.S. PATENT DOCUMENTS

| | | | |
|---|---|---|---|
| 679,028 | 7/1901 | Larmore | 52/727 |
| 1,956,963 | 5/1934 | Salmer | 85/45 |
| 2,032,693 | 3/1936 | Fries | 52/106 |
| 2,043,207 | 6/1936 | Bayley | 52/106 |
| 2,386,151 | 10/1945 | Traatvetter | 52/213 |
| 2,503,537 | 4/1950 | Youngblood | 52/106 |
| 2,771,970 | 11/1956 | Geyser | 52/215 |
| 3,266,207 | 8/1966 | Biram | 52/235 |
| 3,267,631 | 8/1966 | Hammitt | 52/771 |
| 3,380,210 | 4/1968 | Neal | 52/772 |
| 3,509,674 | 5/1970 | Birum | 52/772 |
| 3,566,565 | 3/1971 | Pond | 52/208 |
| 3,775,926 | 12/1973 | Brown | 52/717 |
| 3,800,488 | 4/1974 | Swanson | 52/217 |
| 3,858,375 | 1/1975 | Silvernail | 52/235 |
| 3,906,671 | 9/1975 | Maldonado | 52/212 |
| 4,015,390 | 4/1977 | Howorth | 52/772 |
| 4,114,595 | 9/1978 | Barker | 52/460 |

FOREIGN PATENT DOCUMENTS

| | | | |
|---|---|---|---|
| 294313 | 3/1967 | Australia | 52/772 |
| 1113555 | 9/1961 | Fed. Rep. of Germany | 52/106 |
| 449218 | 4/1968 | Switzerland | 49/505 |
| 724129 | 2/1955 | United Kingdom | 52/498 |

OTHER PUBLICATIONS

Page 1 of U.S. Pat. No. 4,015,390 with color coded drawing.

*Primary Examiner*—Price C. Faw, Jr.
*Assistant Examiner*—H. E. Raduazo
*Attorney, Agent, or Firm*—Harvey G. Lowhurst

[57] ABSTRACT

Several embodiments of window frame assemblies comprising novel window framing members for supporting a glazing product are described. In one embodiment, a window frame assembly is described comprising a conventional framing member including a novel rotatable rod means for preventing the cutting through of the framing member as by a saw. In another embodiment, a window frame assembly is described comprising a frame member for installing pre-glazed windows with or without a rotatable rod means in the framing member, said member including a separately attachable leg member for attaching the pre-glazed window to a pre-installed sub-framing member. In still other embodiments, window frame assemblies are described comprising novel mullions for joining pairs of pre-glazed windows. The mullions, as described, may optionally include means for the attachment of a partition and the aforementioned rotatable rod means.

12 Claims, 10 Drawing Figures

WINDOWS AND METHOD OF MAKING THE SAME

This is a division of application Ser. No. 603,046, filed Aug. 8, 1975, now U.S. Pat. No. 4,115,964.

BACKGROUND OF THE INVENTION

The installation of a glazing product, such as a sheet of glass, a sheet of plastic, a ventilator and the like in an opening typically involves the use of a plurality of framing members for supporting the glazing product about its edges. The term glazing product, as commonly used in the glazing industry and as used herein, means any product which is installed in a frame erected in a wall opening or the like. The terms "glazed window" or "window", as used herein unless otherwise indicated from the context, means an assembly comprising a glazing product glazed in a frame.

Windows may comprise a single sheet of glazing product which is supported about its edges by a plurality of framing members or they may comprise two or more sheets of glazing product, in which case there is further provided a framing member called a mullion for joining the sheets.

The installation or erection of windows may take several forms depending on the particular type of windows, the number and arrangement of the windows and the nature of the opening in which they are erected. In one type of erection, a part of the framing members used for supporting the windows is installed in the opening. The glazing product is then inserted and a glazing stop attached for retaining the glazing product in the frame. Caulking, putty or other sealants are then inserted between the framing members and the glazing product to seal the window against the weather.

The erection of windows in the manner just described is time-consuming and costly because of the labor involved. This is particularly true in the erection of windows in high-rise buildings because of the precautions that must be taken in transporting unsupported glass sheets.

Principally for these reasons, the glazing industry has turned to a more efficient method of erecting windows in which the windows are factory glazed. That is, the glazing products are glazed in their framing members before being taken to the job site. Once at the job site, they are installed over a pre-installed sub-framing member or otherwise fixed in a prepared opening.

The present invention is in part related to these types of windows—that is, to novel window frame assemblies which may be pre-glazed at the factory.

With the advent of new glazing products and because of the aesthetic and beneficial characteristics of windows, windows are being used more frequently in place of steel bars and the like for enclosing openings in security areas, such as prisons, warehouses, and the like.

When used in such applications, it is obviously necessary to prevent entry of the window. This requires not only the use of an unbreakable glazing product but also the employment of means for preventing destruction of the framing members holding the glazing product.

Presently, the most widely used materials for window framing members are aluminum and relatively thin steel. Both of these materials are relatively easy to saw or otherwise cut. Consequently, so far as it appears, others, heretofore, have been dissuaded from attempting to replace barred openings and the like with ordinary appearing, but much more aesthetically pleasing windows on a large scale.

To prevent a successful entry through a window using such framing materials, the present invention employs rotatable rod members in each of the framing members.

The use of rotatable rod members is known to have been proposed long ago for use in prison bars and the like for preventing the successful sawing or cutting thereof, but so far as is known, no one heretofore has suggested their use for preventing the destruction of an otherwise relatively easily destructable window framing member.

SUMMARY OF THE INVENTION

In view of the foregoing, a principal object of the present invention is a novel window frame assembly and method for fabricating pre-glazed windows comprising novel framing members. Another object of the invention is a novel mullion for installing pre-glazed windows. Another object of the present invention is a window frame assembly comprising means for preventing the cutting through of a framing member as by a saw or the like.

In accordance with the above objects, there is provided in one embodiment of the present invention, a window frame assembly having framing members comprising: a T-shaped framing member; a glazing stop with means for attaching said stop to said T-shaped member to form a U-shaped channel for securing a glazing product; and an L-shaped framing member with means for attaching said L-shaped member to said T-shaped member to form a U-shaped channel for securing said framing member to a pre-installed sub-framing member.

In another embodiment of the present invention, rotatable rod means are provided in a framing member for preventing the sawing through of said framing member. In this embodiment, a means is also employed for preventing the non-destructive disassembly of the framing member.

In still other embodiments of the present invention, there is provided a novel mullion means for erecting a pair of pre-glazed windows with and without means for preventing the non-destructive disassembly of said mullion means. In certain ones of these embodiments, a means is optionally provided for the attachment of a partition.

DESCRIPTION OF THE DRAWINGS

The above and other objects, features and advantages of the present invention will be apparent from the following detailed description of the accompanying drawings in which.

DETAILED DESCRIPTION

The terms "glazing product", while typically used in reference to one or more sheets of glass, are considered in the glazing industry, and are used herein, as referring to any product—e.g., a sheet of glass, a sheet of plastic or a ventilator assembly—which is capable of being glazed in a frame. Similarly, the term "window" is considered in the glazing industry, and is used herein, as referring not merely to the glazing product but rather to the entire assembly of glazing product and supporting frame members.

With respect to the following description, it should also be understood that all of the novel framing members of the present invention need not necessarily be identical in any given installation but that, depending on the application, one or more of the members in a given installation may be constructed somewhat differently. For example, the header and jamb framing members may be identical in cross-section, while the sill framing member is constructed for attachment using sill clips and the like. Such features are considered conventional and form no part of the present invention beyond the fact that they may be used as required with framing members made in accordance with the invention.

Figure 2:
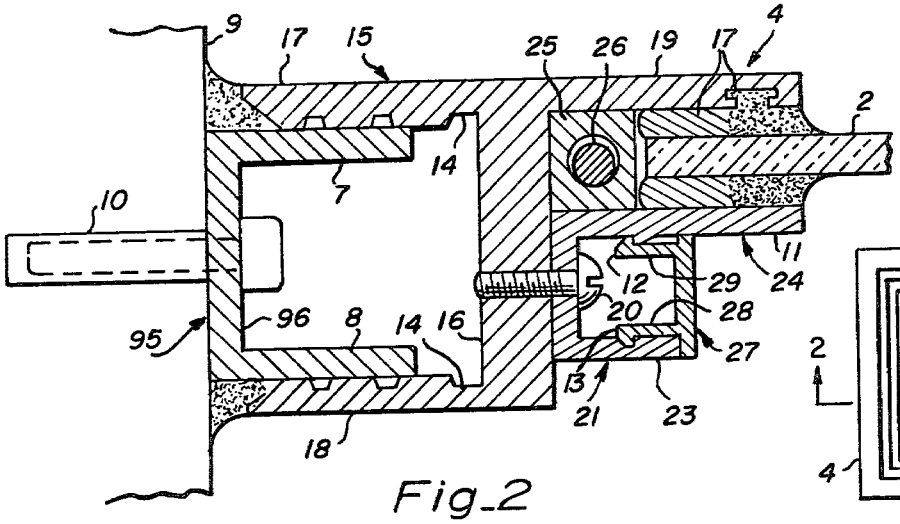
FIG. 2 is a cross-sectional view taken along lines 2—2 of FIG. 1.
Figure 1:
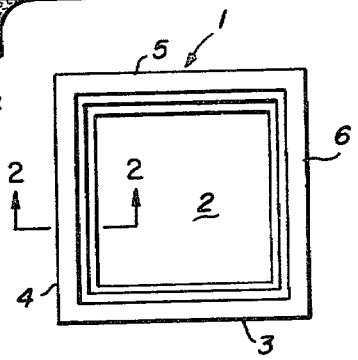
FIG. 1 is an elevation view of a single window unit in accordance with the present invention.

Referring to FIGS. 1–2, there is provided in accordance with the present invention a window 1 comprising a glazing product 2 which is supported in a plurality of framing members 3, 4, 5 and 6. For purposes of describing the present invention, each of the framing members 3–6 has an identical cross-section. It is understood, however, that one or more of them may be constructed differently for adaptation to the requirements of a particular installation. Accordingly, only one of the framing members, member 4, need be described.

Referring to FIG. 2, there is provided in framing member 4 and a sub-framing member 95. Member 95 typically comprises a U-shaped channel having a base section 96 and a pair of spaced parallel leg members 7 and 8 extending therefrom. For attachment to a jamb, comprising a concrete or wooden surface 9, or the like, there is provided one or more attaching fittings 10 which, depending on the application, may comprise a lag bolt, screw, nut and bolt, or the like. Fittings 10, only one of which is shown, are positioned at preselected intervals along the length of the framing member.

Fitted about the sub-framing member 95 is an h-shaped framing member 15. Member 15 has a relatively thick base section 16 from which extend in opposite directions a pair of spaced parallel leg members 17 and 18 and a single leg member 19. Members 17 and 18 form a U-shaped channel for receiving the member 95. Member 19 forms a part of another U-shaped channel for receiving the glazing product 2. To reduce weight and conserve material, the interior surfaces of leg members 17 and 18 are provided with a plurality of parallel extending grooves or recesses 14, 14 . . .

Spaced from leg member 19 and attached to section 16 of member 15 as by a screw 20 is a U-shaped glazing stop 21. Stop 21 has a base section 22 from which extend a pair of spaced parallel leg members 23 and 24. Leg member 24 is provided with an extended section 11 and is, therefore, somewhat longer than member 23 such that it is substantially coextensive with member 19. The U-shaped channel thus formed between leg members 19 and 24 serves as a receiving space for the glazing product 2.

Mounted at selected locations along the length of framing member 4 in the channel formed by leg members 19 and 24 is one or more block members 25. Each of block members 25 is provided with a hole through which is passed an elongated rotatable rod member 26. The length of the member 26 is preferably substantially equal to the length of the framing member 4. The holes have a diameter slightly larger than the diameter of the rod member so as to allow the rod member to rotate freely therein. The number, size and location of the blocks 25 in each of the framing members 3–6 are chosen such that any expected lateral forces on the rod member 26 are insufficient to bend and bind the rod member by friction in the holes so as to prevent its free rotation. Also, the blocks 26 are preferably formed from a material having a low coefficient of friction and the rod member 26 is formed from a material having the hardness and resistance to cutting as by sawing of tool steel.

The purpose, therefore, of the blocks is to serve as a bearing surface for the rod member 26 such that, if any attempt is made to saw through the framing member 4, the saw, when contacting the rod member 26, will cause the rod member to rotate in the blocks. This is effective to prevent cutting of the rod member. From the foregoing, it follows that, for long lengths of rod, the rod member 26 should be supported at several points so as to prevent its being bent by a saw such that it becomes bound in a block and can then be cut.

To prevent non-destructive disassembly of the window 1, there is further provided a non-removable cover member 27. Member 27, after the window is installed, is inserted between the legs of stop 21 to cover the screw means 20.

In the cover member 27, there is provided, extending from the interior surfaces thereof, a pair of spaced leg members 28 and 29. Members 28 and 29 are, respectively, terminated by a shouldered clip-like termination 12 and 13 for non-removable engagement with a corresponding pair of engaging surfaces in the surfaces of leg members 23 and 24 of the stop 21. Termination 12 and 13 serves to prevent the non-destructive removal of the cover 27 and, thereby, the non-destructive disassembly of the framing member 4.

To install a window according to the embodiment of FIGS. 1 and 2 in a pre-constructed opening, the sub-framing member 95 and the corresponding member in each of the members 3, 5 and 6 are fitted with a plurality of fittings 10 and inserted between the legs 17 and 18 of the h-shaped member 15. They are temporarily secured there as by masking tape or the like. The member 15, with the member 5 so secured, is then inserted and plumbed in the opening. Through pilot holes (not shown) in the base section 16 of member 15, which are located in registration with the fittings 10, the fittings 10 are then screwed into or otherwise fixed in the header, jambs and sill. The blocks 25 and the rod members 26 are then positioned with the glazing product 2 supported therebetween. Finally, stop 21 is installed, weather sealing material 97 is added between the glazing product 2 and leg members 19 and 24 and cover 27 is inserted.

Figure 4:
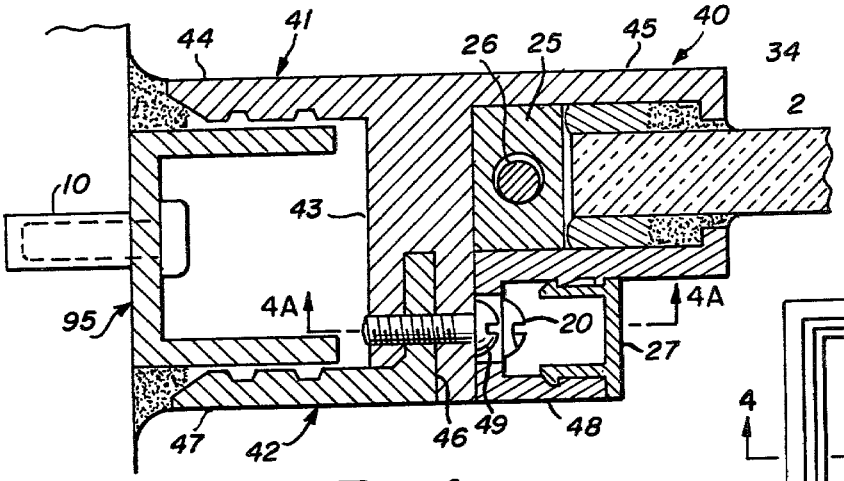
FIG. 4 is a cross-sectional view taken along lines 4—4 of FIG. 3.
Figure 3:
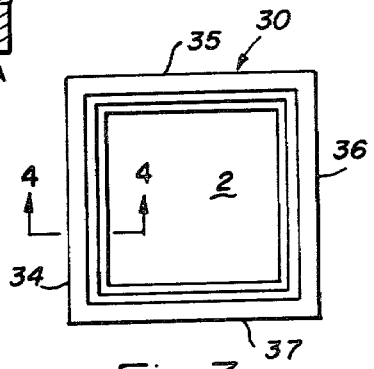
FIG. 3 is an elevation view of a single window unit in accordance with another embodiment of the present invention.
Figure 4A:
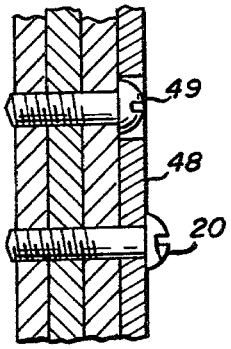
Figure 4B:
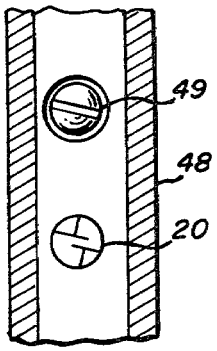

Referring to FIGS. 3–4, there is provided in another embodiment of the present invention a window 30.

Window 30 comprises a glazing product 2, as described above with respect to FIGS. 1–2, supported in a plurality of framing members 34, 35, 36 and 37. Each of the members 34, 35, 36 and 37 is identical and accordingly only one—namely, member 34—is described.

Referring to FIG. 4, there is provided in the member 34 a number of the features of the member 4 of FIG. 2. As to those members which are identical in both embodiments, the same numerical designators are employed for identification purposes and a reference to the discussion above is invited for the details of their construction. Included in the list of features which are identical in both embodiments are the sub-framing member 5 and fitting 10, the block 25 and rod member 26, and the cover member 27.

Figure 5:
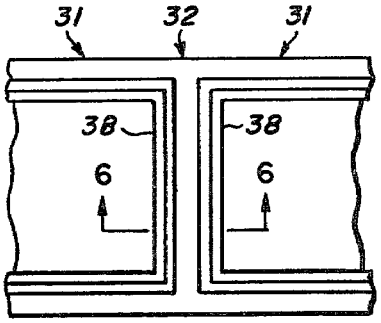
FIG. 5 is a partial elevation view of a double window unit with a mullion in accordance with the present invention.

In contrast to member 15 of FIG. 2, there are provided in the embodiment of FIG. 5, a main framing member 40 comprising two separable members, a T-shaped framing member 41 and L-shaped framing member 42. Member 41 has a thick base section 43 from which extends from one end thereof a pair of oppositely directed leg members 44 and 45. L-shaped member 42 comprises a pair of perpendicular leg members 46 and 47. In the base section 43, opposite the end from which members 44 and 45 extend, is a recess for recessing the leg 46 of member 42. Attached to the base section 43 by means of a screw means 20 is a glazing stop 48. In stop 48 and in base section 43, in communication with the recess and in registration with each other, is a pilot hole for receiving a screw means 49. Screw means 49 is used for fixedly attaching the leg member 46 in the recess in the base section 43. Because of the pilot hole in the stop 48, however, screw means 49 can be inserted and member 42 secured before stop 48 is attached. As previously described, in all other essential respects, the remaining features of the framing member 40 are identical to the same features in the member 4 of FIGS. 1–2 and reference may be made to the description above for the details with respect to those features.

Figure 6:
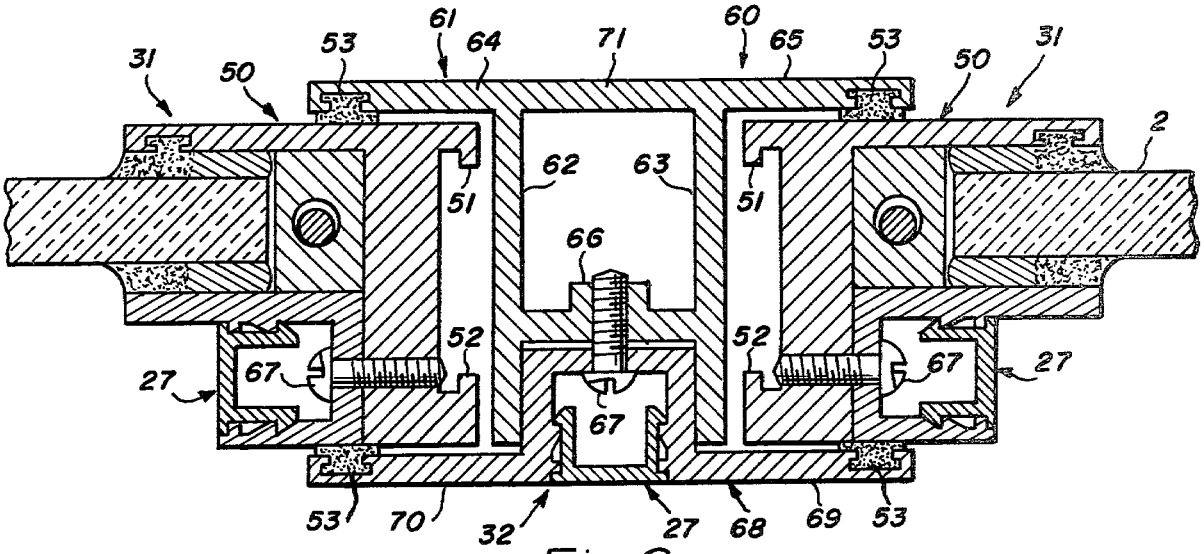
FIG. 6 is a cross-sectional view taken along lines 6—6 of FIG. 5.

Referring to FIGS. 5 and 6, there is provided a pair of window units 31, 31 which are joined by a mullion 32 according to the present invention. Windows 31, 31 may comprise the framing members of the embodiments described above except that there is typically a modification to the inside members 38, 38 . . . joined by the mullion.

In the members 38, 38 . . . there is provided an h-shaped main framing 50 which is similar to the h-shaped member 15 described with respect to FIGS. 1-2. The only essential difference between two members 50 and 15 is that the pair of parallel leg members 17 and 18 of member 15 are foreshortened in member 50 and terminated by a pair of inwardly directed flanges 51 and 52. In addition, a plurality of sealing members 53, 53 . . . are provided between the framing members 40, 50 . . . for weather sealing. In all other respects, the features of members 50 are identical to those of member 4 of FIG. 2.

In mullion 32 there is provided a pair of L-shaped members 60 and 61. Members 60 and 61 comprise a pair of spaced parallel leg members 62 and 63 and a pair of oppositely directed leg members 64 and 65 which are rigidly attached by a bridging member 71 and a recessed bridging member 66, recessed between the legs 62 and 63. Attached to the bridging member 66 as by a screw means 67 is a face plate 68 comprising a pair of spaced oppositely directed legs or plate members 69 and 70. The space between the plate members 69 and 70 is recessed to fit in the recess provided by the recessed bridge member 66 between the leg members 62 and 63 of the members 60 and 61. As described above with respect to the embodiments of FIGS. 1–4, screw means 67 is covered by a cover member 27 which is non-removably inserted in the recess of plate 68 of engage corresponding shouldered surfaces in the interior walls thereof.

Figure 7:
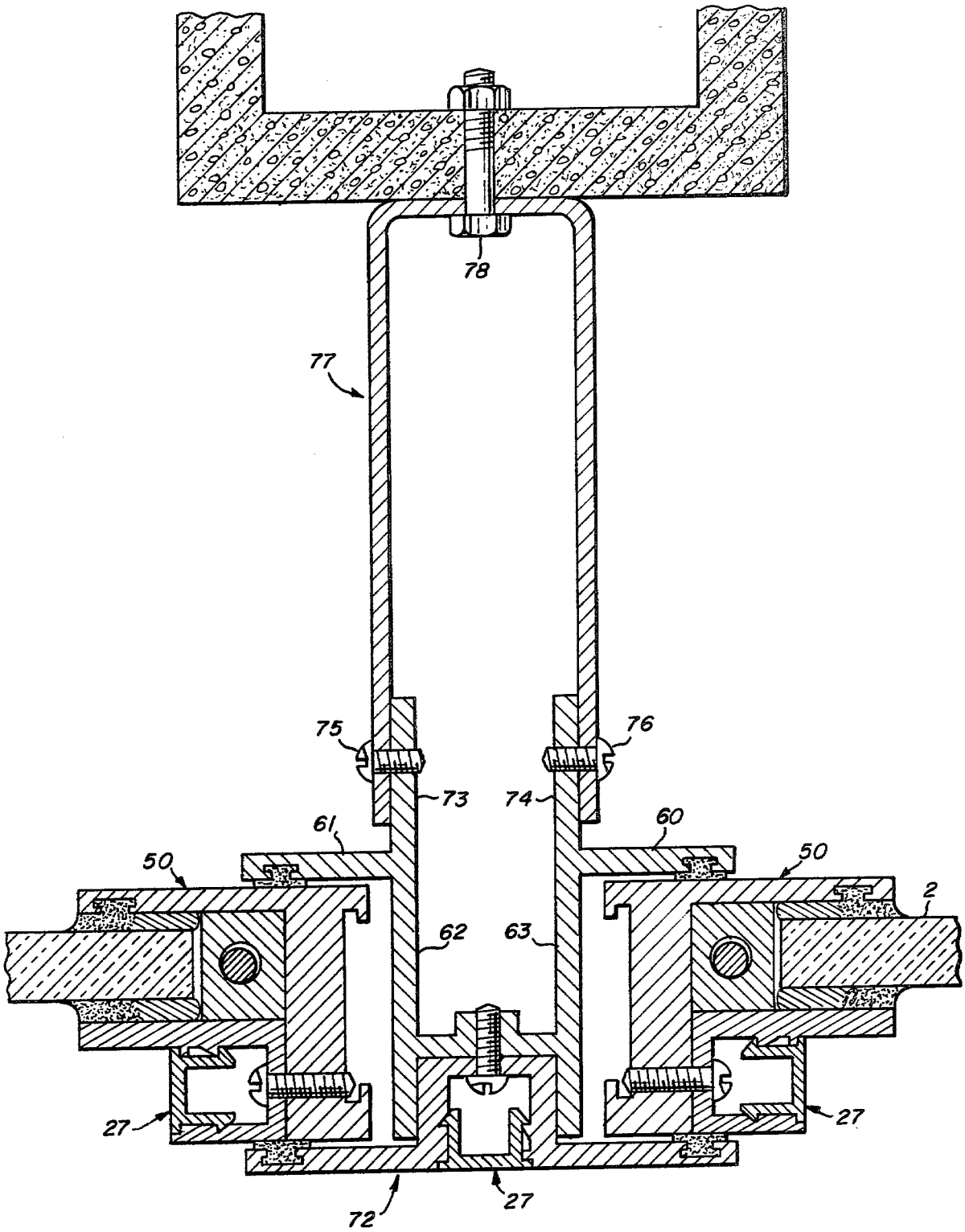
FIG. 7 is a cross-sectional view of an alternative embodiment of the mullion of FIG. 5.

Referring to FIG. 7, there is provided a mullion 72 which is an alternative embodiment of the mullion 32 of FIG. 6. In mullion 72, the bridging member 71 of FIG. 6 is omitted. Parallel leg members 62 and 63 are extended by means of a pair of parallel flange members 73 and 74 somewhat beyond the plane of leg members 60 and 61. Attached to flange members 73 and 74 as by rivets or screws 75 and 76, or the like, is an elongated U-shaped channel 77. Channel 77 may be ridigly attached to a partition, wall or the like by means of one or more fittings 78. In all other respects, the mullion 72 is identical to the mullion 32 of FIG. 6.

Figure 8:
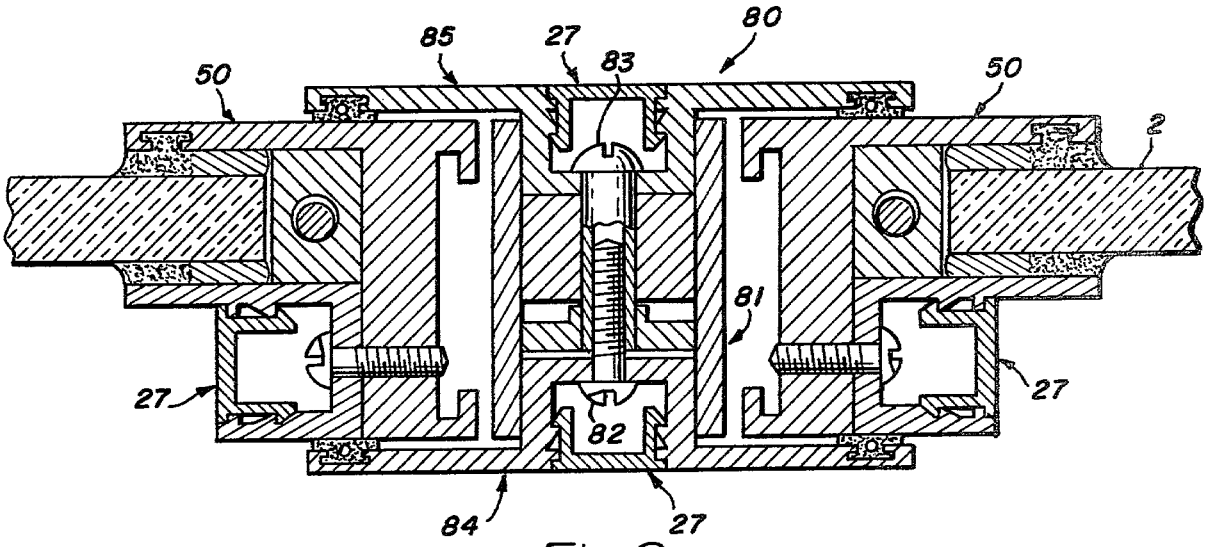
FIG. 8 is a cross-sectional view of another alternative embodiment of the mullion of FIG. 5.

In FIG. 8, there is shown yet another embodiment of a mullion according to the present invention.

Referring to FIG. 8, there is provided in a mullion 80 an H-shaped framing member 81. Attached to opposite sides of member 81, in the recesses between its parallel legs, as by screw means 82 and 83, are a pair of identical facing plate members 84 and 85. Each of plate members 84 and 85 are identical to facing plate member 68 of FIG. 6 and incorporate cover members 27, as shown in FIG. 6.

In the installation of the windows according to the embodiments of FIGS. 3–8, the sub-framing members 5 are first attached to and plumbed in the sides of a pre-constructed opening in a wall or the like except for that part of the frame contiguous to a mullion. The remainder of the frame, which is preferably pre-glazed, is then inserted and the attachable L-shaped framing member 42 is fitted and tightened in the recess of the T-shaped member 41 by the screw means 49. The glazing stop 21, which is at that time already attached by the screw means 20, is then fitted with the cover 27 to cover the screw means 20 and 49.

With respect to the erection of the mullions of FIGS. 5–8, the installation procedure is equally simple since all that is required, once the mullion is in place, is the attachment of the respective face plates. With respect to the embodiment of FIG. 8, of course, the mullion can be reversed since two opposing attachable face plates are used.

It is apparent from the foregoing that various combinations of the embodiments described may be incorporated in a given installation depending on the requirements of the job. It is also apparent that various modifications can be made to the embodiments described, as required, without departing from the spirit and scope of the present invention. It is, therefore, intended that the embodiments described serve only as illustrations of the present invention and that the true scope of the invention be determined by reference to the claims hereinafter provided.

What is claimed is:

1. A window frame assembly comprising:

a U-shaped sub-framing member;

a T-shaped main framing member;

an L-shaped facing member;

a rod member;

a rod bearing member having a hole for receiving and supporting said rod member such that said rod member is free to rotate therein;

a U-shaped glazing stop;

a non-removable snap-on cover;

means including screw means in said glazing stop for attaching said L-shaped facing member to said main framing member of forming a first U-shaped channel, said first U-shaped channel being adapted for placement over said U-shaped sub-framing member;

means including screw means in said glazing stop for attaching said U-shaped glazing stop to said main framing member for forming a second U-shaped channel; said second U-shaped channel being adapted for retaining a glazing product;

means for placing rod bearing block member at a selected location in said second U-shaped channel; and means for non-removably inserting said snap-on cover between the legs of said U-shaped glazing stop.

2. A window frame assembly comprising;

a U-shaped sub-framing member;

an h-shaped main framing member forming a first U-shaped channel, said first U-shaped channel being adapted for placement over said U-shaped sub-framing member;

a rod member;

a rod bearing member having a hole for receiving and supporting said rod member such that said rod member is free to rotate therein;

a U-shaped glazing stop;

a non-removable snap-on cover;

means including screw means in said glazing stop for attaching said U-shaped glazing stop to said main framin member for forming a second U-shaped channel, said second U-shaped channel being adapted for retaining a glazing product;

means for placing said rod bearing member at a selected location in said second U-shaped channel; and means for non-removably inserting said snap-on cover between the legs of said U-shaped glazing stop.

3. An assembly for mulling a pair of glazing products, comprising:

a double T-shaped mullion member defining a pair of opposite leg members extending straight across said mullion, a pair of parallel leg members, and an interior intermediate bridging member across and between said parallel leg members to define an open parallel leg recess;

a face plate member including a pair of opposite leg members and a U-shaped center channel depending inwardly from said member, said center channel being dimensioned for placement into said parallel leg recess;

means including screw means in said center channel for attaching said face plate member to said bridging member so that the opposite leg members of said mullion member and of said face plate member forms a pair of oppositely facing U-shaped edge channels for retaining the glazing products; and a non-removable snap-on cover inserted between the legs of said center channel.

4. An assembly in accordance with claim 2 in which the outwardly facing surface of said double T-bar mullion member is substantially planar.

5. An assembly in accordance with claim 4 in which the outwardly facing surface of said face plate member is substantially planar and parallel with the outwardly facing surface of said double T-bar mullion member.

6. An assembly in accordance with claim 3 in which the edge of the glazing product received by said edge channel includes a frame assembly comprising:

an L-shaped main frame member, a U-shaped glazing stop means including screw means for attaching said U-shaped glazing stop to said main frame member and for forming a further U-shaped channel for retaining said glazing product, and a non-removable snap-on cover inserted between the legs of said U-shaped glazing stop.

7. An assembly in accordance with claim 6 which further includes a rod member, a rod bearing member having an opening for receiving and supporting said rod member such that same rod member is free to rotate therein, and means for placing said rod bearing member at a selected location in said further U-shaped channel.

8. An assembly for mulling a pair of glazing products, comprising:

an H-shaped mullion member defining a pair of oppositely facing U-shaped parallel leg recesses;

a pair of similar face plate members including a pair of opposite leg members and a U-shaped center channel depending inwardly from said leg members, said center channels being dimensioned for placement into said parallel leg recesses;

means including screw means in said center channels for attaching said face plate members to the center member of said mullion member so that the leg members of said pair of face plate members form a pair of oppositely facing U-shaped edge channels for retaining said glazing products; and a pair of non-removable snap-on covers inserted between the legs of said U-shaped center channels.

9. An assembly in accordance with claim 8 in which the outwardly facing surface of at least one of said face plate members is substantially planar.

10. An assembly in accordance with claim 8 in which the outwardly facing surfaces of both said face plate members are substantially planar and parallel.

11. An assembly in accordance with claim 8 in which the edge of the glazing product received by said edge channel includes a frame assembly comprising:

an L-shaped main frame member, a U-shaped glazing stop means including screw means for attaching said U-shaped glazing stop to said main frame member and for forming a glazing product U-shaped channel for retaining said glazing product, and a non-removable snap-on cover inserted between the legs of said U-shaped glazing stop.

12. An assembly in accordance with claim 11 which further includes a rod member, a rod bearing member having an opening for receiving and supporting said rod member such that same rod member is free to rotate therein, and means for placing said rod bearing member at a selected location in said glazing product U-shaped channel.

* * * * *

UNITED STATES PATENT AND TRADEMARK OFFICE

CERTIFICATE OF CORRECTION

PATENT NO. : 4,270,332

DATED : June 2, 1981

INVENTOR(S) : George W. Montrouil

It is certified that error appears in the above—identified patent and that said Letters Patent is hereby corrected as shown below:

The term of this patent subsequent to September 26, 1995, has been disclaimed.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*